US007854569B1

(12) United States Patent
Stenson et al.

(10) Patent No.: US 7,854,569 B1
(45) Date of Patent: Dec. 21, 2010

(54) UNDERWATER UNMANNED VEHICLE RECOVERY SYSTEM AND METHOD

(75) Inventors: Ryan Michael Stenson, Washington, DC (US); Daniel J. Braun, San Diego, CA (US); Lonnie A. Hamme, Jamul, CA (US); Christopher D. Mailey, Durham, NC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/333,184

(22) Filed: Dec. 11, 2008

(51) Int. Cl.
*B63G 8/41* (2006.01)

(52) U.S. Cl. ..... 405/188; 405/191; 114/322

(58) Field of Classification Search ..... 405/185, 405/188, 190, 191; 114/258, 259, 260, 313, 114/322, 330, 337
See application file for complete search history.

(56) References Cited

U.S. PATENT DOCUMENTS 6,148,759 A * 11/2000 Taylor, Jr. ..... 114/312
6,390,012 B1 * 5/2002 Watt et al. ..... 114/322
6,502,527 B1 1/2003 Danielson
6,540,426 B2 4/2003 Cloyd et al.
6,600,695 B1 * 7/2003 Nugent et al. ..... 114/312
6,698,376 B2 * 3/2004 Delahousse et al. ..... 114/322
6,779,475 B1 8/2004 Crane et al.
7,000,560 B2 2/2006 Wingett
7,350,475 B2 4/2008 Borgwarth et al.
2008/0006197 A1 * 1/2008 Lambertus et al. ..... 114/313

FOREIGN PATENT DOCUMENTS

DE 102004062124 B3 * 6/2006
FR 2832975 * 11/2001

* cited by examiner

*Primary Examiner*—Frederick L Lagman
(74) *Attorney, Agent, or Firm*—Kyle Eppele; J. Eric Anderson

(57) ABSTRACT

In various embodiments, an apparatus for use in the recovery of unmanned underwater vehicles includes a recovery vehicle configured to be coupled to a winch via a tether. The recovery vehicle includes one or more sensors for locating the unmanned underwater vehicle, a first mechanical linking device for coupling the recovery vehicle to the unmanned underwater vehicle, and a plurality of steering mechanisms for actively guiding the unmanned underwater vehicle in such a way as to allow the first mechanical linking device to capture the unmanned underwater vehicle by locking onto a second mechanical linking device of the unmanned underwater vehicle.

3 Claims, 5 Drawing Sheets

UNDERWATER UNMANNED VEHICLE RECOVERY SYSTEM AND METHOD

FEDERALLY SPONSORED RESEARCH AND DEVELOPMENT

This invention (Navy Case No. 099145) was developed with funds from the United States Department of the Navy. Licensing inquiries may be directed to the Office of Research and Technical Applications, Space and Naval Warfare Systems Center, San Diego, Code 2112, San Diego, Calif., 92152; voice 619-553-2778; email T2@spawar.navy.mil.

BACKGROUND

I. Field

This disclosure relates to systems and methods for the deployment and recovery of unmanned underwater vehicles.

II. Background

Unmanned underwater vehicles (UUVs) are forms of robots that travel underwater. Generally, UUVs include autonomous underwater vehicle (AUVs), which are devices that require no human control, and non-autonomous Remotely Operated underwater vehicles (ROVs), which are undersea vehicles that are controlled and powered from a remote location by an operator/pilot via an umbilical communications connection.

When UUVs are deployed, it becomes generally necessary to recover such devices. However, such recovery procedures can be extremely difficult, especially when the UUVs are autonomous devices having limited power or other resources (e.g., long-range underwater gliders), and no ready means to communicate with the outside world. Currently, launch and recovery operations of these assets are conducted with high risk to small boats, swimmer personnel and high-value equipment. Generally, a small boat or swimmer, in variable ocean conditions, must physically move to a UUV to attach a tow or lift line, or retrieve the vehicle by hand. This is extremely dangerous in high sea states.

With increasingly demanding requirements, the necessity to operate in higher sea states and from ships with differing freeboards, new recovery methods and devices for UUVs are desirable.

SUMMARY

Various aspects and embodiments of the invention are described in further detail below.

In a first series of embodiments, an apparatus for use in the recovery of unmanned underwater vehicles includes a recovery vehicle configured to be coupled to a winch via a tether. The recovery vehicle includes one or more sensors for locating the unmanned underwater vehicle, a first mechanical linking device for coupling the recovery vehicle to the unmanned underwater vehicle, and a plurality of steering mechanisms for actively guiding the unmanned underwater vehicle in such a way as to allow the first mechanical linking device to capture the unmanned underwater vehicle by locking onto a second mechanical linking device of the unmanned underwater vehicle.

In another series of embodiments, an apparatus for use in the recovery of unmanned underwater vehicles includes a recovery vehicle configured to be coupled to a winch via a tether. The recovery vehicle includes locating means for locating the unmanned underwater vehicle, linking means for coupling the recovery vehicle to the unmanned underwater vehicle, and steering means for actively guiding the unmanned underwater vehicle in such a way as to allow the linking means to capture the unmanned underwater vehicle by locking onto a second linking means of the unmanned underwater vehicle.

In another series of embodiments, a method for the recovery of unmanned underwater vehicles using a recovery vehicle coupled to a winch via a tether includes steering the recovery vehicle within an appreciably close range of the unmanned underwater vehicle using a remote steering system, a plurality of steering mechanisms of the recovery vehicle, and one or more first sensors of the recovery vehicle, placing the recovery vehicle into a capture mode, wherein when in the capture mode the recovery vehicle captures the unmanned underwater vehicle using a first mechanical linking device for coupling the recovery vehicle to the unmanned underwater vehicle and one or more sensors incorporated into the recovery vehicle configured to determine relative position of the unmanned underwater vehicle to the recovery vehicle, and retrieving both the recovery vehicle and unmanned underwater vehicle using the tether and winch.

BRIEF DESCRIPTION OF THE DRAWINGS

The features and nature of the present disclosure will become more apparent from the detailed description set forth below when taken in conjunction with the accompanying drawings in which reference characters identify corresponding items.

DETAILED DESCRIPTION

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
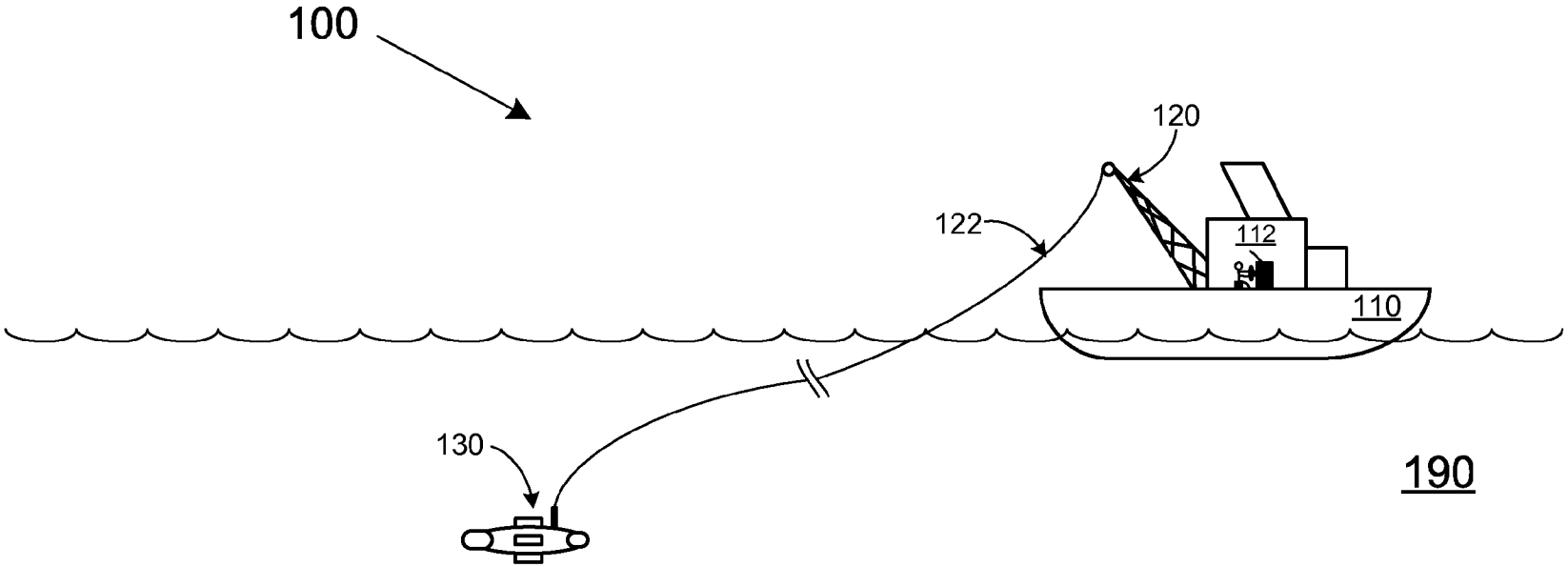
FIG. 1 is an exemplary unmanned underwater vehicle recovery system.

FIG. 1 is an exemplary unmanned underwater vehicle (UUV) recovery system 100. As shown in FIG. 1, the UUV recovery system 100 includes a remote surface platform 110, e.g., a ship, having a winch 120 and connected to an underwater Recovery Vehicle (RV) 130 via a tether 122. The remote surface platform 110 floats on the surface of water 190.

In operation, an operator at an operating center 112 on the remote surface platform 110 can deploy the RV 130 to search for a UUV, guiding the RV 130 through an area where a UUV is known or suspected to be. Note that the RV 130 may be guided and/or propelled using any number of mechanical devices, such as steerable water jets, steerable propellers, and one or more propellers with rudders. Also note that, in various other embodiments, the RV 130 may be propelled by virtue of being pulled by the remote surface platform 110 with steering accomplished using only a number of rudders/steering fins.

Still also note that, in lieu of a human operator, the RV 130 may be guided automatically using sensors and computer control equipment located on platform 110 and/or on the RV 130.

Continuing, the RV 130 may be guided to an appreciably close proximity of a UUV using any number of sensors to aid an operator, whether the operator be human or computer-based. Such sensors may include vision systems, such as cameras having low-light capability, sonar, LIDAR, magnetic sensors, EM sensors, and so on. While it is envisioned that such location sensors may be located within or on the RV 130, in various embodiments some, part of some, or all of the sensors may be located on the remote platform 110. For example, in an exemplary configuration, location of a UUV may be accomplished through a combination of an array of CCD array cameras on the RV 130, an active sonar on the remote surface platform 110, and a semi-active transponder system where a UUV responds to an sound or electro-magnetic (EM) pulse emitted by the remote surface platform 110 by emitting another sound and/or EM pulse that may be sensed by the RV 130.

Once the RV 130 is guided to an appreciably close range to a UUV, the RV 130 may operate on an autonomous or semi-autonomous mode to capture the UUV as will be further explained below. Once captured, the UUV and RV 130 may be retrieved to the surface platform 110 via the winch 120 and tether 122.

Figure 2:
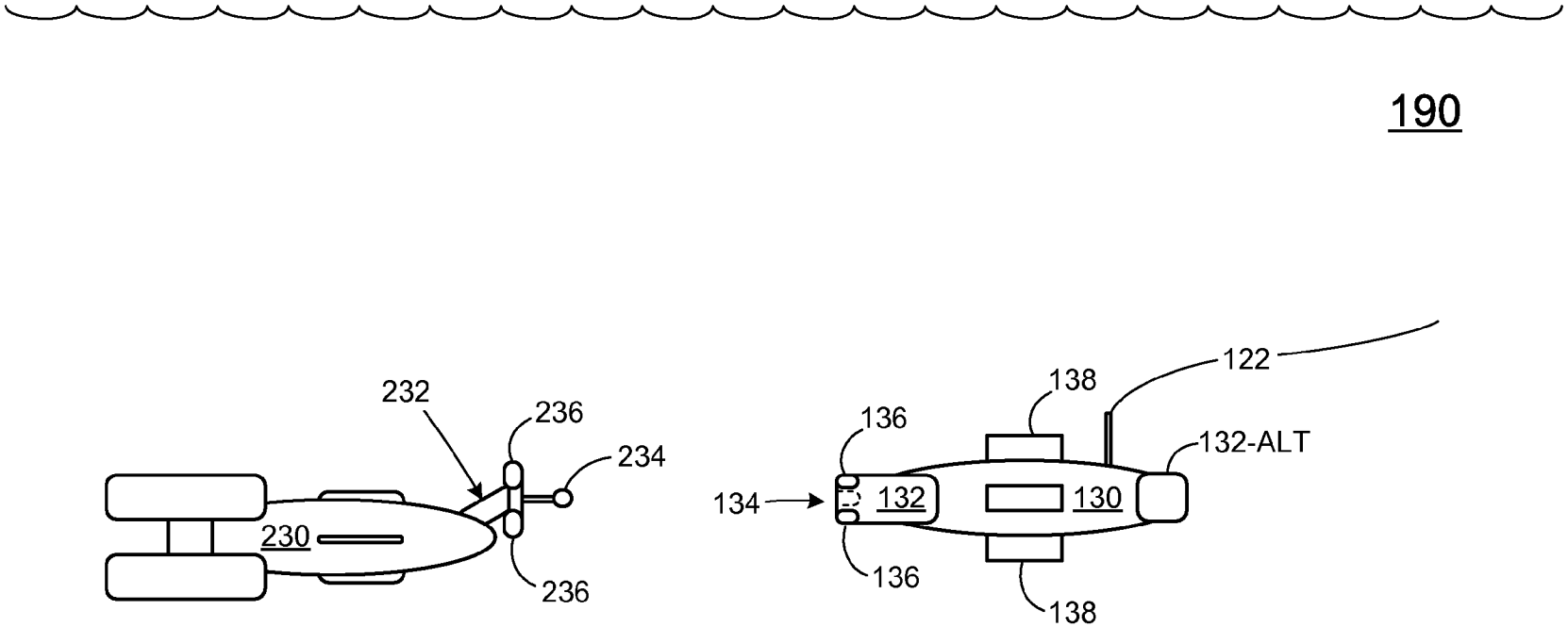
FIG. 2 depicts an unmanned underwater vehicle together with the recovery vehicle of FIG. 1.

FIG. 2 depicts an exemplary UUV 230 together, i.e., within an appreciable range, of the exemplary RV 130 of FIG. 1. As shown in FIG. 2, the exemplary RV 130 includes a set of steering water jets 138 and a recovery apparatus 132 having internal control and communication electronics (not shown), a first set of sensing/communication devices 136 and a first mechanical capture device 134. An alternative recovery apparatus 132-ALT, may be used to demonstrate the idea that sensors and mechanical linkages may be located anywhere on the RV 130.

In reference to FIG. 2, the exemplary UUV 230 includes internal control and communication electronics (not shown) and a mating spar 232, which itself includes a second set of sensing/communication devices 236 and a second mechanical capture device 234. Note that the exemplary "mating spar" shown in FIG. 2 is to help demonstrate the different portions of the overall systems and is not intended to be limiting. For example, the exemplary second set of sensing/communication devices 236 may be directly incorporated into the body of the UUV 230, and the second mechanical capture device 234 may extend directly from the body of the UUV 230.

In operation, once the RV 130 and UUV 230 are within an appreciably close range, e.g., a range where the RV 130 might effectively sense the relative location and/or communicate with the UUV 230, the RV 130 may work in an autonomous (or principally autonomous) mode where the RV 130 can use any number or combination of sensing devices, such as vision systems, LIDAR, RADAR, SONAR, laser-based scanning systems, magnetic sensors, EM sensors, transponders, and so on, to determine the relative location and possibly velocity of the UUV 230.

Further, in various embodiments, the RV 130 may use any number or combination of communication devices capable of short-range (or longer) communication, such as EM/radio, laser or sound-based communication systems, to establish a communication link with the UUV 230 and possible establish control of the UUV's actions. For example, in various embodiments the RV 130 and UUV may establish a 2-way link using FM modulated radio signals so as to allow the RV 130 to take control of the UUV's speed and direction, thus allowing for a "closed-loop" controlled capture of the UUV 230.

It should be appreciated that during operation coupling the RV 130 and UUV 230 may be done in a variety of ways. For example, the RV 130 may be made to "bump" the UUV 230 (or vice versa) head-on, tail-to-head, head-to-tail, or even couple from above or below.

Figure 3:
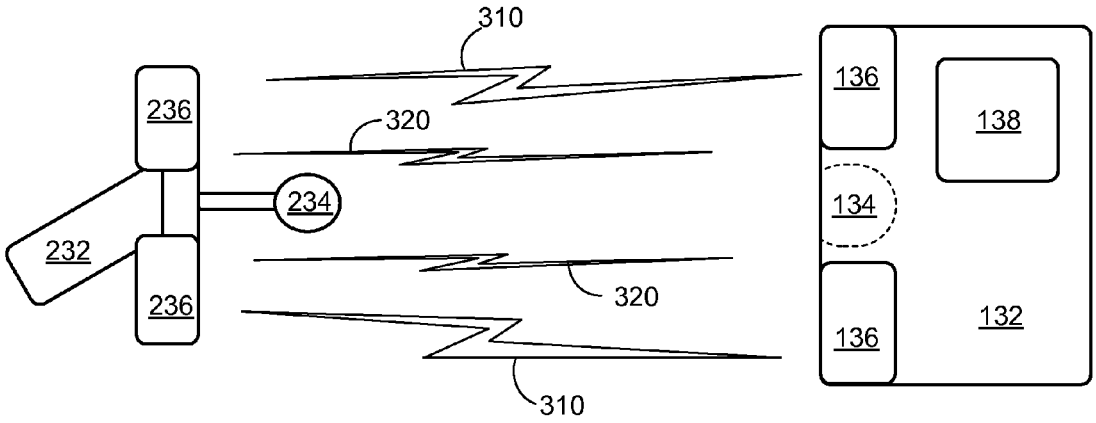
FIG. 3 depicts an exemplary coupling and sensor configuration for the unmanned underwater vehicle together and recovery vehicle of FIG. 2.

FIG. 3 is a depiction of the forward spar 232 of the UUV of FIG. 2 (along with the second set of sensing/communication devices 236 and the second mechanical capture device 234), as well as the aft/capture portion 132 of the RV 130 (along with the first set of sensing/communication devices 136, the second mechanical capture device 134, and a control module 138 for communication, operating sensors and interpreting sensor data, and conducting autonomous UUV 230 capture routines. Also depicted in FIG. 3 are the various sensing and/or communication energies 310 emitted/provided by (or reflected off) the RV 130, as well as are the various sensing and/or communication energies 320 emitted/provided by (or reflected off) the UUV 230.

Still also shown in FIG. 3, the first and second mechanical capture devices 134 and 234 together include a ball-and-socket style connector having multiple degrees of freedom. That is, because an RV 130 and target UUV 230 may not be perfectly aligned and may have different pitch, yaw and roll angles relative to one another, a capture mechanism may benefit from a design that allows for such circumstances. Possible mechanical configurations of such ball-and-socket style connectors are known in the relevant arts, and specific examples of such devices can be found in U.S. Pat. No. 6,540,426 entitled "Passive ball capture joint", U.S. Pat. No. 6,186,693 1 entitled "Passive capture joint with three degrees of freedom" and U.S. Pat. No. 2,755,105 entitled "BALL AND SOCKET COUPLING MECHANISM", the contents of all of these patents being herein incorporated by reference in their entirety.

While the present example includes a ball-and-socket style coupling, it is to be appreciated that other types of connector/coupling systems may also be usable depending on various circumstances, such as the mass of a recovered UUV 230. For example, it may be beneficial to use a magnetic coupling system, a suction-based coupler, an active moving mechanical coupling system capable of being pointed in different directions, and so on.

Figure 4:
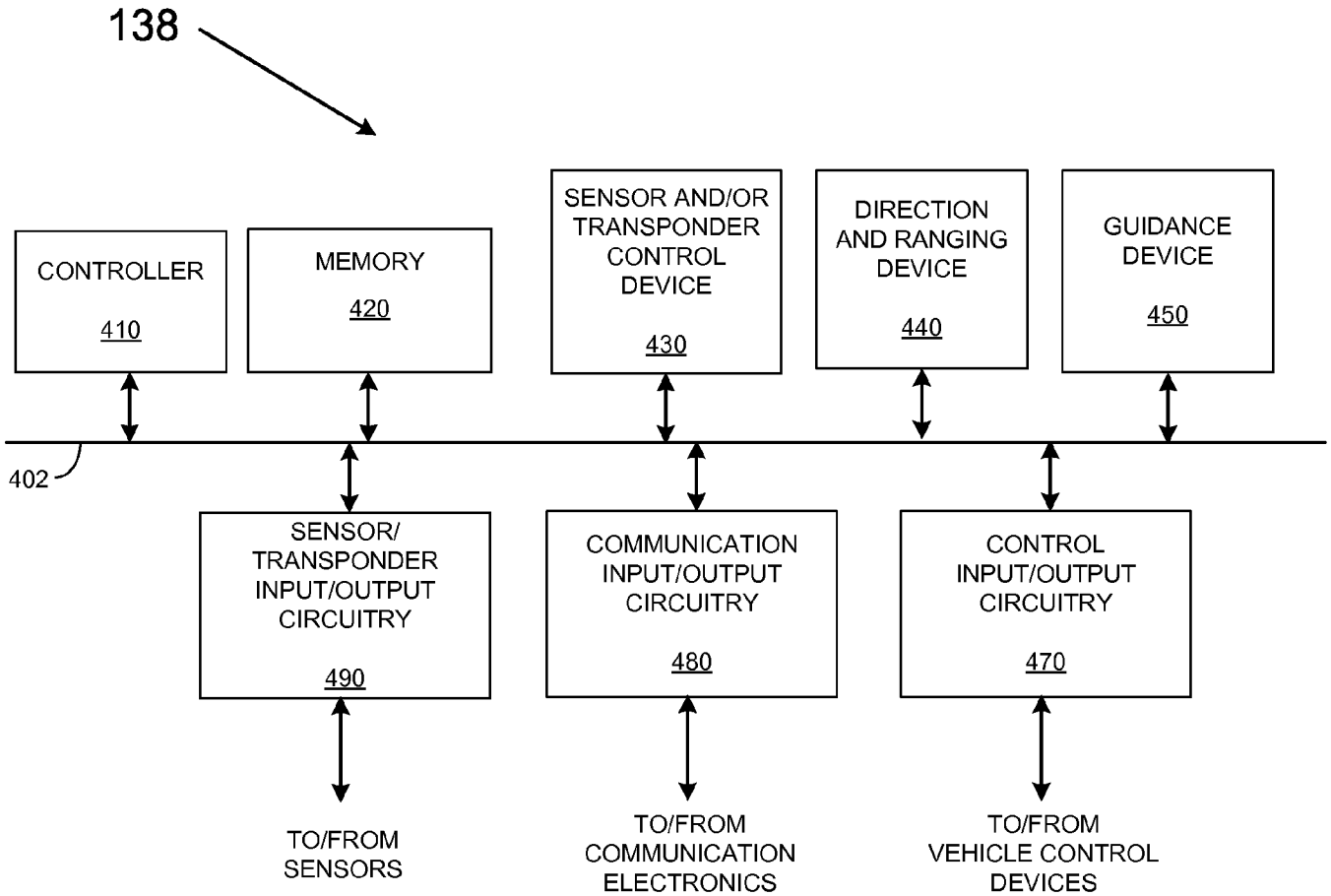
FIG. 4 is a processing system for the recovery vehicle of FIG. 3.

Continuing, FIG. 4 is a control system 138 for the recovery vehicle of FIG. 3. As shown in FIG. 4, the exemplary control system 138 includes a controller 410, a memory 420, a sensor and transponder control device 430, a ranging and direction device 440, a guidance device 450, control input/output circuitry 470, communication input/output circuitry 480 and sensor/transponder input/output circuitry 490. The above-components 410-490 are coupled together using control/data bus 402.

Although the exemplary control system 138 of FIG. 4 uses a bussed architecture, it should be appreciated that any other architecture may be used as is well known to those of ordinary skill in the art. For example, in various embodiments, the various components 410-490 can take the form of separate electronic components coupled together via a series of separate busses.

Still further, in other embodiments, one or more of the various components 410-490 can take form of separate processing systems coupled together via one or more networks. Additionally, it should be appreciated that each of components 410-490 advantageously can be realized using multiple computing devices employed in a cooperative fashion.

It also should be appreciated that some of the above-listed components 430-450 can take the form of software/firmware routines residing in memory 420 and be capable of being executed by the controller 410, or even software/firmware routines residing in separate memories in separate computing systems being executed by different controllers.

It also should be appreciated from the discussion above that the control module 138 can accommodate both an autonomous and manual operation for both a searching mode of operation and a capture mode of operation.

For manual modes of operation, the control module 138 may be limited in its functionality to, e.g., merely collecting sensor and/or transponder data via the sensor/transponder input/output circuitry 490, and forwarding such data to a remote operator via the communication input/output circuitry 480. Such tasking may optionally include the interim processing of sensor and transponder data in order to provide an operator with enhanced data (e.g., provide relative position data (rather than raw data) and/or enhanced or compressed video), may also be provided by the control module 138. Other processing in manual mode may include accepting commands from the remote operator via the communication input/output circuitry 480, and controlling various propellers, control fins, water jets, and so on, based on such remote operator commands.

For automatic modes of operation, i.e., where no remote human operator is used, there are again two operational modes: a searching mode of operation and a capture mode of operation.

During the searching mode, under control of the controller 410 various sensors and/or transponders may be activated and controlled by the sensor/transponder control device 430 via the sensor/transponder input/output circuitry 490. Accordingly, the resultant sensor/transponder data collected by sensors incorporated into the RV 130 may be imported by the sensor/transponder input/output circuitry 490, and stored in memory 420. Additionally, remote sensor data, such as sonar data provided by a remote surface platform, may be imported via the communication input/output circuitry 480 under control of the controller 410, and also stored in memory 420. Thereafter, the ranging and detection device 440 may use the various sensor and/or transponder data to search for a UUV 230 and provide a relative position of the UUV 230 to the guidance device 450. Accordingly, the guidance device 450 may determine the appropriate commands to give whatever steering and propulsion mechanisms that the RV 130 has, and issue such commands to such steering and propulsion mechanisms until the RV 130 comes within an appreciable proximity to the UUV 230.

After the RV 130 is in proximity of the UUV 230, the control module 138 may enter a capture mode in order to mechanically couple the RV 130 to the UUV 230 via a mechanical coupling system, such as the ball-and-socket joints discussed above. Upon entering the capture mode, the control module 138 may use the same set of sensors used for steering mode, or may employ other sensors more suitable for determining relative location in finer increments of angle and/or distance. For example, in a steering mode the control module 138 may use remotely provided sonar data, but switch to combination local vision system and laser-based scanning system to determine relative UUV 230 position once in capture mode.

Additionally, the controller 410 may optionally make direct communication with the UUV 230 using the communication input/output circuitry 480 and a short-range communication system incorporated into both the RV 130 and UUV 230, such as a two-way EM radio or infrared laser-based communication device. Again, as mentioned before, such a communication interface may be used to control the actions of the UUV 230 in order to provide a closed-loop control system to more precisely guide a mechanical coupling on the UUV 230 to a complementary mechanical coupling device on the RV 130. Again, the sensor/transponder control device 430, the ranging and detection device 440, and the guidance device 450 may be used to control sensors, collect sensor data, determine relative position and determine the appropriate guidance commands to issue to either or both the RV 130 and UUV 230.

Figure 5:
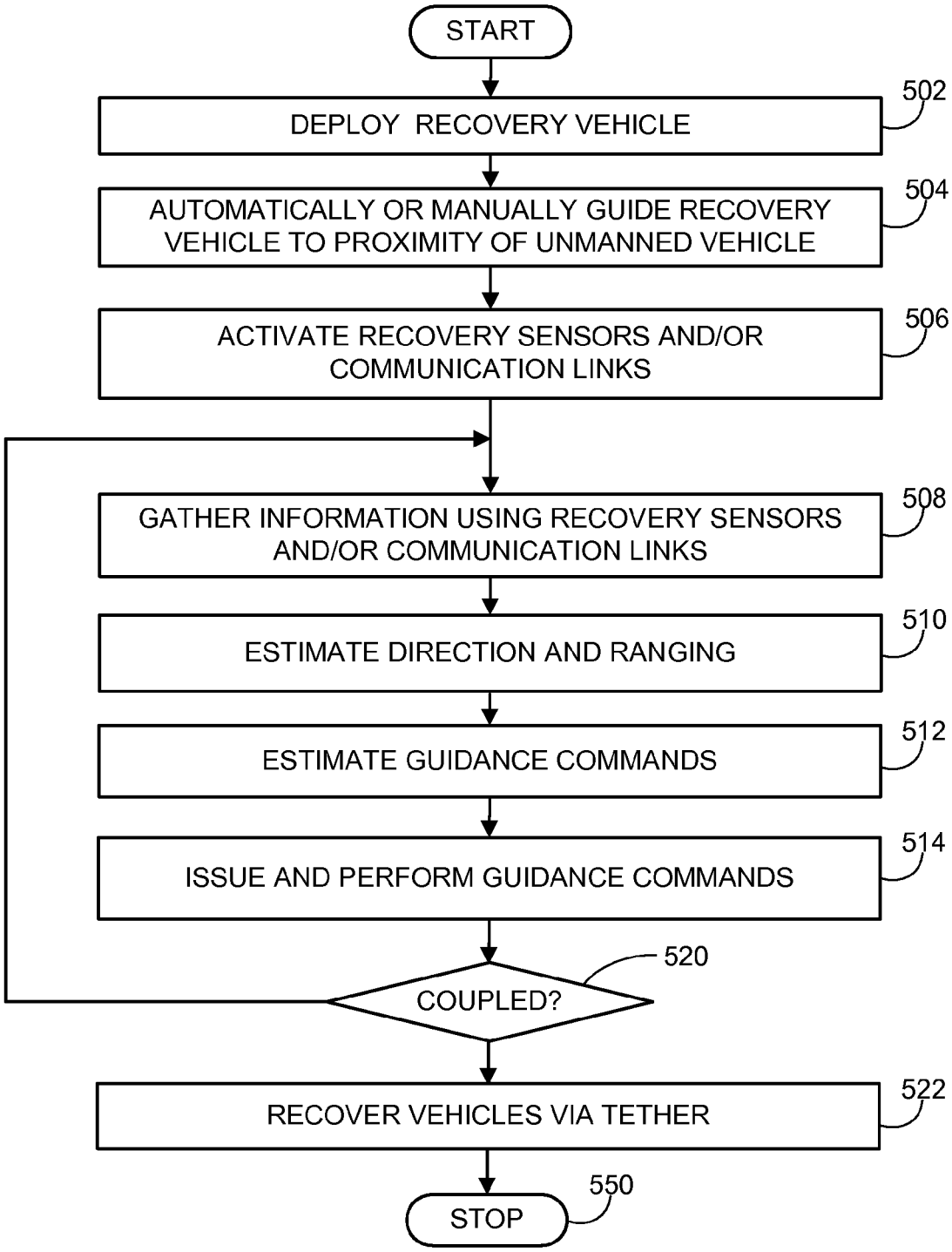
FIG. 5 is a flowchart outlining an exemplary process for capturing an unmanned underwater vehicle.

FIG. 5 is a flowchart outlining an exemplary process for capturing an unmanned underwater vehicle. The process starts in step 502 where an RV 130 may be deployed to recover/capture a UUV 230. Next, in step 504, the RV 130 may be steered to an appreciable proximity of the UUV 230 using one or more first sensors under control of a human or (optionally) a computer-based operator. Again, as mentioned above, sensors deployed on a surface platform 110 or on the RV 130 may be used to facilitate guidance. Then, in step 506, assuming that the RV 130 is in such an appreciable distance that local sensors and/or communication devices may be effectively used with the UUV 230, the appropriate sensors/transponders and communication links may be activated. Control continues to step 508.

In step 508, sensor/transponder data of sensors incorporated in the RV 130, as well as remote sensor data, may be accumulated and stored. Additional data, such as telemetry data derived by the UUV 230 and sent over the appropriate communication link, may also be collected and stored. For example, while the RV 130 may use a local sonar and vision system to determine relative position of the RV 130 to the UUV 230, relative velocity data may be derived using RV 130-based velocity sensors and velocity sensors, e.g., gyroscopes, incorporated into the UUV 230 and sent over the appropriate communication link. Next, in step 510, relative direction, (optional) velocity and ranging information may be derived, and in step 512 the appropriate guidance commands may be derived for either or both the RV 130 and UUV 230. Control continues to step 514.

In step 514, the guidance commands derived in step 512 may be issued and performed by the RV 130 and/or UUV 230 so as to guide a mechanical coupling of the UUV 230 to a complementary coupling device on the RV 130. Next, in step 520, a determination is made as to whether the RV 130 and UUV 230 are securely coupled. If the RV 130 and UUV 230 are securely coupled, then control continues to step 522; otherwise, control jumps back to step 508 where after steps 508-520 can be repeated as necessary.

In step 522, the RV 130 and UUV 230 may be redeployed to a remote surface platform 110 via a winch 120 and tether 122 until the RV 130 and UUV 230 are secured to the surface platform 110, and control continues to step 550 where the process stops.

In various embodiments where the above-described systems and/or methods are implemented using a programmable device, such as a computer-based system or programmable logic, it should be appreciated that the above-described systems and methods can be implemented using any of various known or later developed programming languages, such as "C", "C++", "FORTRAN", Pascal", "VHDL" and the like.

Accordingly, various storage media, such as magnetic computer disks, optical disks, electronic memories and the like, can be prepared that can contain information that can direct a device, such as a computer, to implement the above-described systems and/or methods. Once an appropriate device has access to the information and programs contained on the storage media, the storage media can provide the information and programs to the device, thus enabling the device to perform the above-described systems and/or methods.

For example, if a computer disk containing appropriate materials, such as a source file, an object file, an executable file or the like, were provided to a computer, the computer could receive the information, appropriately configure itself and perform the functions of the various systems and methods outlined in the diagrams and flowcharts above to implement the various functions. That is, the computer could receive various portions of information from the disk relating to different elements of the above-described systems and/or methods, implement the individual systems and/or methods and coordinate the functions of the individual systems and/or methods related to communications.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A recovery apparatus comprising:

a frame;

a tether connection device coupled to the frame such that the frame may be tethered to a remote surface platform;

one or more long-range and close-range location sensors coupled to the frame configured to locate and communicate with an untethered unmanned underwater vehicle (UUV);

wherein the long-range and close-range location sensors are acoustic and non-acoustic sensors;

a first mechanical linking device coupled to the frame, wherein the first mechanical linking device is configured to mechanically capture the UUV;

a plurality of steering mechanisms coupled to the frame, wherein the plurality of steering mechanisms are configured to actively guide the frame through a body of water in such a way as to allow the first mechanical linking device to capture the UUV when underwater;

wherein the apparatus is configured to be remotely controlled by an operator in order to position the frame within an appreciably close range of the UUV;

wherein when the frame is within the appreciably close range of the UUV, the apparatus is configured to then autonomously capture the UUV;

a short-range communication system configured to communicate with the UUV; and wherein the apparatus is configured to control movement of the UUV via the short-range communication system.

2. An apparatus for use in the recovery of unmanned underwater vehicles, comprising:

a recovery vehicle configured to be coupled to a winch via a tether, wherein the recovery vehicle includes, locating means for locating an untethered unmanned underwater vehicle;

linking means for coupling the recovery vehicle to the untethered unmanned underwater vehicle;

one or more long-range and close-range location sensors coupled to the recovery vehicle wherein said sensors are configured to locate and communicate with the untethered unmanned underwater vehicle;

wherein the long-range and close-range location sensors are acoustic and non-acoustic sensors;

steering means for actively guiding the untethered unmanned underwater vehicle in such a way as to allow the linking means to capture the untethered unmanned underwater vehicle by locking onto a second linking means of the untethered unmanned underwater vehicle; and wherein the recovery vehicle is configured to control movement of the unmanned underwater vehicle via a short-range communication means.

3. A method for the recovery of an untethered unmanned underwater vehicle (UUV) comprising:

coupling a recovery vehicle to a winch via a tether;

steering the recovery vehicle within an appreciably close range of the UUV using a remote steering system, a plurality of steering mechanisms of the recovery vehicle, and one or more first sensors of the recovery vehicle;

placing the recovery vehicle into a capture mode, wherein when in the capture mode the recovery vehicle captures the untethered unmanned underwater vehicle using a first mechanical linking device for coupling the recovery vehicle to the untethered unmanned underwater vehicle, and one or more sensors incorporated into the recovery vehicle configured to determine relative position of the UUV to the recovery vehicle;

retrieving both the recovery vehicle and UUV using the tether and winch; and wherein the step of capturing includes using a short-range communication system onboard the recovery vehicle to control movement of the UUV.

* * * * *